US005619863A

United States Patent [19]

Kil

[11] Patent Number: 5,619,863

[45] Date of Patent: Apr. 15, 1997

[54] OUTDOOR UNIT OF A SEPARATE TYPE AIR CONDITIONER

[75] Inventor: Yong H. Kil, Suwon, Rep. of Korea

[73] Assignee: Samsung Electronics Co., Ltd., Suwon, Rep. of Korea

[21] Appl. No.: 501,339

[22] Filed: Jul. 12, 1995

[30] Foreign Application Priority Data

Aug. 20, 1994 [KR] Rep. of Korea ..... 94-20567

[51] Int. Cl.[6] ..... F25D 17/06

[52] U.S. Cl. ..... 62/428; 62/259.1

[58] Field of Search ..... 62/428, 429, 426, 62/404, 262, 263, 259.1

[56] References Cited

U.S. PATENT DOCUMENTS 3,898,865 8/1975 Stewart et al. ..... 62/262
5,197,299 3/1993 Sohn et al. ..... 62/262

FOREIGN PATENT DOCUMENTS 58-190634 11/1983 Japan ..... 62/296

*Primary Examiner*—John M. Sollecito
*Attorney, Agent, or Firm*—Burns, Doane, Swecker & Mathis, L.L.P.

[57] ABSTRACT

An outdoor air conditioning unit includes a housing comprised of front and rear vertical walls, two side vertical walls, and top and bottom walls. A partition wall extends across an interior space formed by the housing to divide the space into upper and lower portions. Disposed in the upper portion are a motor-driven fan and a heat exchanger, and disposed in the lower portion is a compressor. The fan is mounted on the front wall behind an air outlet opening formed therein. The heat exchanger is generally U-shaped, formed by a rear portion and two side portions. The rear portion is disposed opposite an air inlet opening formed in the housing rear wall, and the side portions are disposed opposite openings formed in respective housing side walls. A top side of the partition wall forms a condensate collection pan. The lower portion of the compressor is surrounded by sound absorbing material disposed in a space formed between two upright portions of the partition wall.

12 Claims, 4 Drawing Sheets

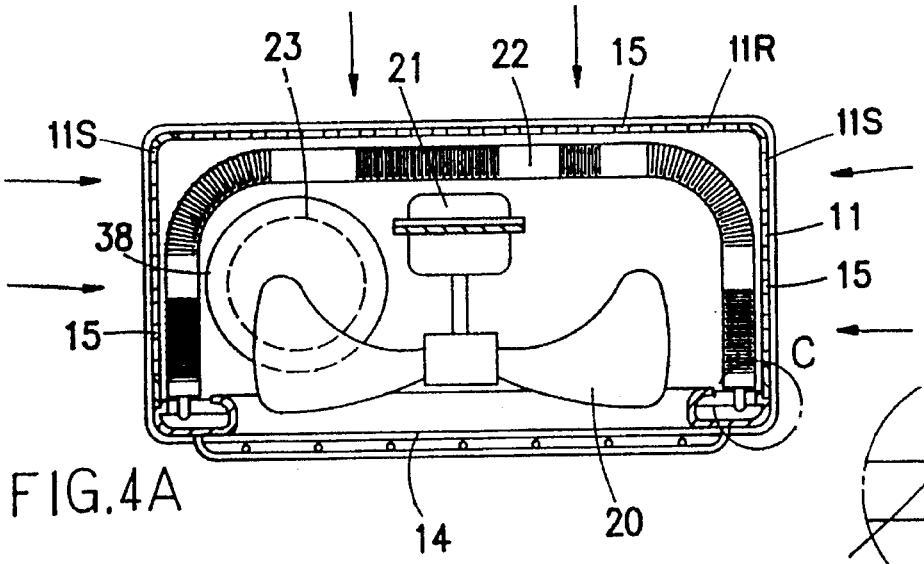
FIG.4A
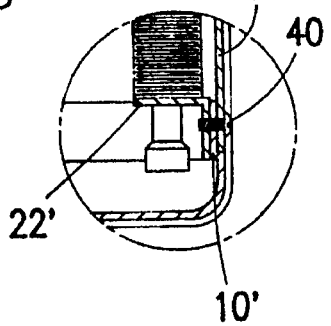
FIG.4B
FIG.5
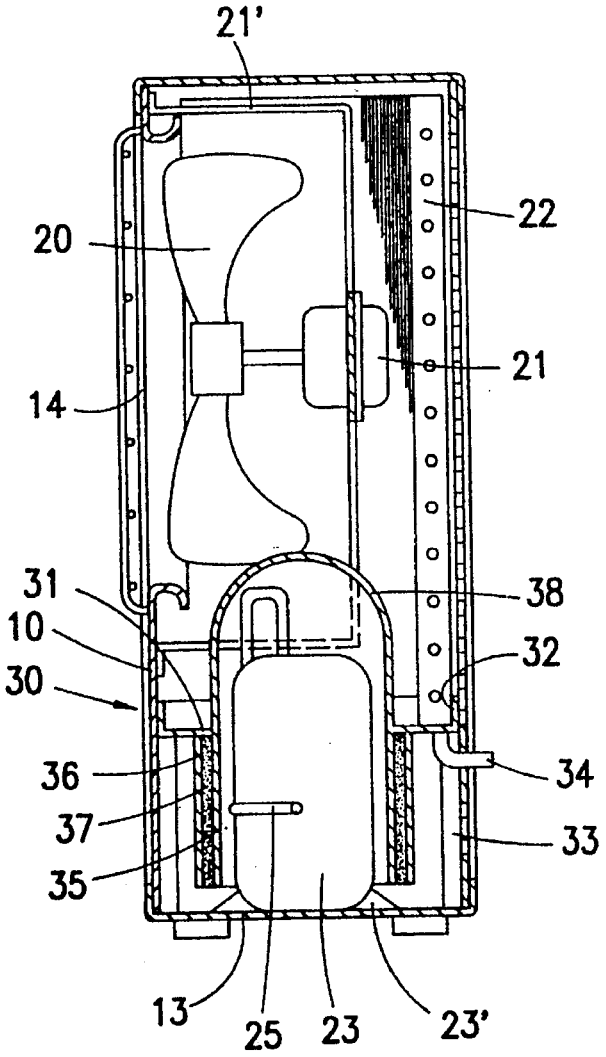

A,B : PRIOR ART
C : THIS INVENTION

OUTDOOR UNIT OF A SEPARATE TYPE AIR CONDITIONER

BACKGROUND OF THE INVENTION

This invention relates to an outdoor unit of a separate-unit air conditioner, and more particularly to an outdoor unit of a separate type air conditioner in which a heat exchanger and a compressor are dispersed.

Generally, a separate-unit air conditioner is comprised of an indoor unit having a heat exchanger and a fan for heat-exchanging the indoor air, and an outdoor unit having another heat-exchanger and a compressor. In the cooling process, the refrigerant compressed by the compressor into a high temperature and high pressure refrigerant is supplied to the outdoor heat-exchanger. The condensed refrigerant is passed through a capillary tube to become a lower temperature and low pressure refrigerant able to evaporate. Then the refrigerant is fed to the indoor heat-exchanger so that indoor air passed through the indoor heatexchanger is cooled.

On the contrary, in the heating process, the direction of the refrigerant flow is reversed. The refrigerant compressed by the compressor into the high temperature and high pressure refrigerant is supplied to the indoor heat-exchanger so as to be condensed. During the condensation, heat generated from the indoor heat-exchanger warms the indoor air. Then the condensed refrigerant is fed back to the compressor in the evaporated state through the capillary tube and the outdoor heat-exchanger.

A large size fan is installed in the outdoor unit to increase the effect of the condensation and the evaporation, but noise from the compressor increases. One type of a conventional outdoor unit, shown in FIGS. 1A and 1B, comprises a fan 1 and a motor 4 mounted at the front central portion of the unit, a compressor 2 vertically installed at the right side of the fan 1, heat-exchanger 3 screening the left side and the rear portion of the fan 1, and a shield plate 5 separating the compressor 2 and the fan 1.

The fan 1 shielded by a top plate 6 and a bottom plate 7 draws outside air through the rear side and the left side of the unit. However, since the heat-exchanger 3 is mounted at the left side and the rear side of the unit and the right space of the fan 1 is blocked, the air flow applied to the fan 1 has a substantial load difference between the right side and the left side, thereby giving the fan a dynamical unbalance which reduces efficiency. Further, the shielding plate 5 merely divides the left space from the right space, i.e., only a partition function between the compressor 2 and the fan 1 is performed. Thus, noise generated by the compressor 2 can be expelled through the right side of the unit. Through the front central portion of the unit, fan noise transfers out, whereas compressor noise comes out through the right side of an unit causing the additional noise increase. Furthermore, during the heating process, condensed water developed from the heat-exchanger 3 is temporarily collected in the bottom plate 7 and is outflowed to the outside. Thus, to prevent the contact of the discharge pipe (not shown) mounted at the bottom plate 7 with the ground, the bottom plate 7 is provided at a distance above the ground to conform to the limited spacial installation.

FIGS. 2A and 2B show another type of a conventional outdoor unit. The outdoor unit comprises a fan 1' and a motor 4' mounted at the front central portion of the unit, a compressor 2' mounted under the fan 1', and elements 8 (e.g., connecting tube, control panel etc.) mounted at left side and right side of the fan 1', respectively. To separate the compressor 2' from the heat-exchanger 3' a domed shielding plate 5' is provided covering the rear area and the upper area of the compressor 2'.

However, because the compressor 2' and the fan 1' are exposed adjacent to the front area of the unit, there is the problem that noise originating from the components is transferred to the front area of the unit. Since the shielding plate 5' is domed, condensed water originating from the heat-exchanger 3' drops onto the bottom plate 7. In this structure, the bottom plate 7 is spaced from the ground to prevent the contact of the discharging tube with the ground, thereby conforming to the limited spacial installation. Since the elements 8,8 are provided at respective left side and right side of the fan 1', the right side surface and the left side surface of the heat-exchanger 1' do not fully cover the fan 1'. Thus, not only is the air inflow through the left side and the right side of the unit restricted due to the blockage by the installation portions 8,8, also respective sizes of the heatexchanger 3' and the inlet opening are reduced, which decreases the efficiency of heat-exchanging.

Further, since air inlets are provided at left side, right side, and rear side of the outdoor unit, the outdoor air is intaken through three sides, so intake air pressure is evenly applied to the fan. Additionally, since the heat-exchanger is formed in a "U" shape corresponding to the arrangement of the inlets, more efficient heat-exchange surface is provided.

Furthermore, because the condensed water collecting pan is formed on the partition panel, the installation of the drain tube is facilitated. More, since the outdoor unit is divided into upper and lower portions by the partition panel enclosed in the outer housing, simpler installation structure can be achieved.

SUMMARY OF THE INVENTION

An object of the present invention is to provide an outdoor unit of a separate-unit type air conditioner in which a compressor is arranged under a fan, thereby providing reduced volume of the installation.

Another object of the present invention is to provide an outdoor unit in which a partition panel is provided between a compressor and a fan, and a partition panel and a noise absorber are arranged around the compressor enabling the reduction of noise during operation.

Yet another object of the present invention is to provide an outdoor unit in which outdoor air flows through three walls and the heat-exchanger is arranged along the three walls in a "U" shape, which improves the dynamic balance of the fan and increases the efficiency of the heat-exchanger.

The final object of the present invention is to provide an outdoor unit in which a condensated water collecting pan is arranged on the partition panel separating the compressor and the fan, so the drain pipe can be conveniently installed.

In accordance with the advantageous features of the present invention, the outdoor unit of an air conditioner comprises a front panel having a bracket mounted thereon, the bracket supporting the fan and motor; a cover having a plurality of inlet openings on three surfaces and for encompassing the rear surface of the front panel; a top panel and a bottom panel for encompassing respective upper portion and lower portion of both the cover and the front panel, respectively; a compressor installed on the bottom panel; a partition means for separating the fan and the compressor in a vertical manner; and a heat-exchanger mounted above the partition means for encompassing the left surface, the right surface and the rear surface of the fan.

As to the above structural outdoor unit, the outdoor unit has the compressor and a fan isolated by the partition panel. Since the compressor is encompassed by the partition panel and the sound absorber, noise of operation of the outdoor unit is clearer reduced.

BRIEF DESCRIPTION OF THE DRAWINGS

FIG. 4A is a horizontally sectioned view of the top of the outdoor unit of an air conditioner of FIG. 3

FIG. 4B is an enlargement view of area C of FIG. 4A;

FIG. 5 is a vertically sectioned view of a side of the outdoor unit of FIG. 3.

DETAILED DESCRIPTION OF THE PREFERRED EMBODIMENT

Figure 1A:
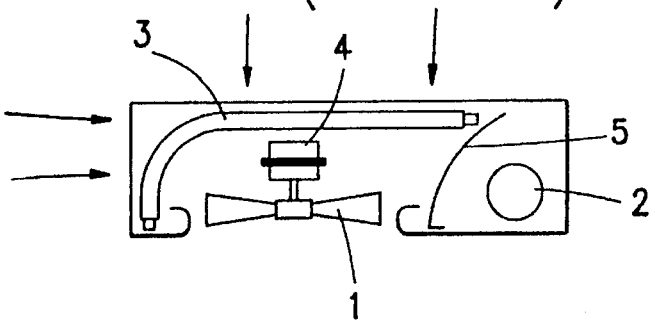
FIG.1A (PRIOR ART)
FIG. 1A is a schematic top view of a prior art outdoor unit of an air conditioner.
Figure 1B:
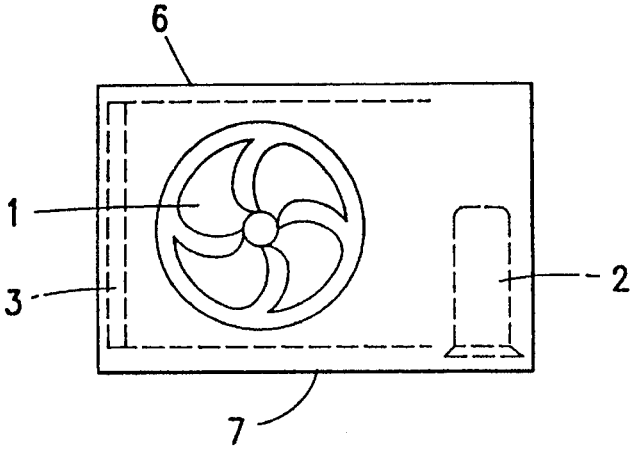
FIG.1B (PRIOR ART)
FIG. 1B is a schematic front view of a prior art outdoor unit of FIG. 1A.
Figure 2A:
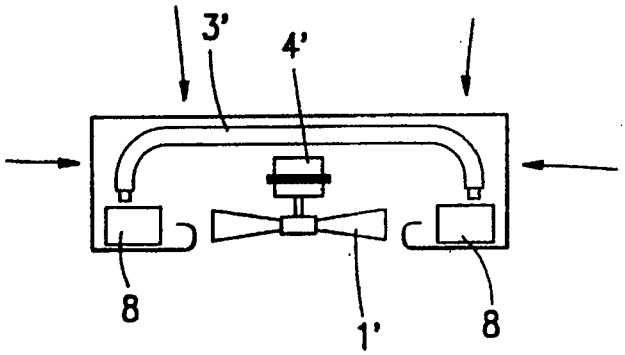
FIG.2A (PRIOR ART)
FIG. 2A is a schematic top view of another prior art outdoor unit of an air conditioner.
Figure 2B:
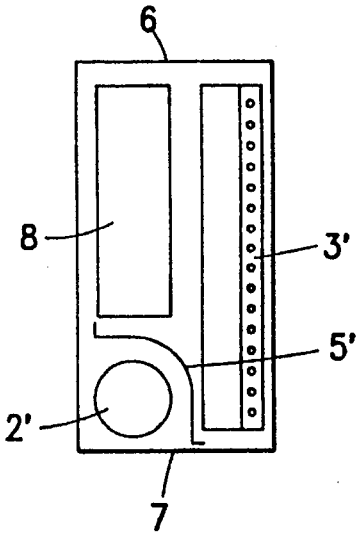
FIG.2B (PRIOR ART)
FIG. 2B is a schematic side vertical view of the prior art outdoor unit of FIG. 2A
Figure 3:
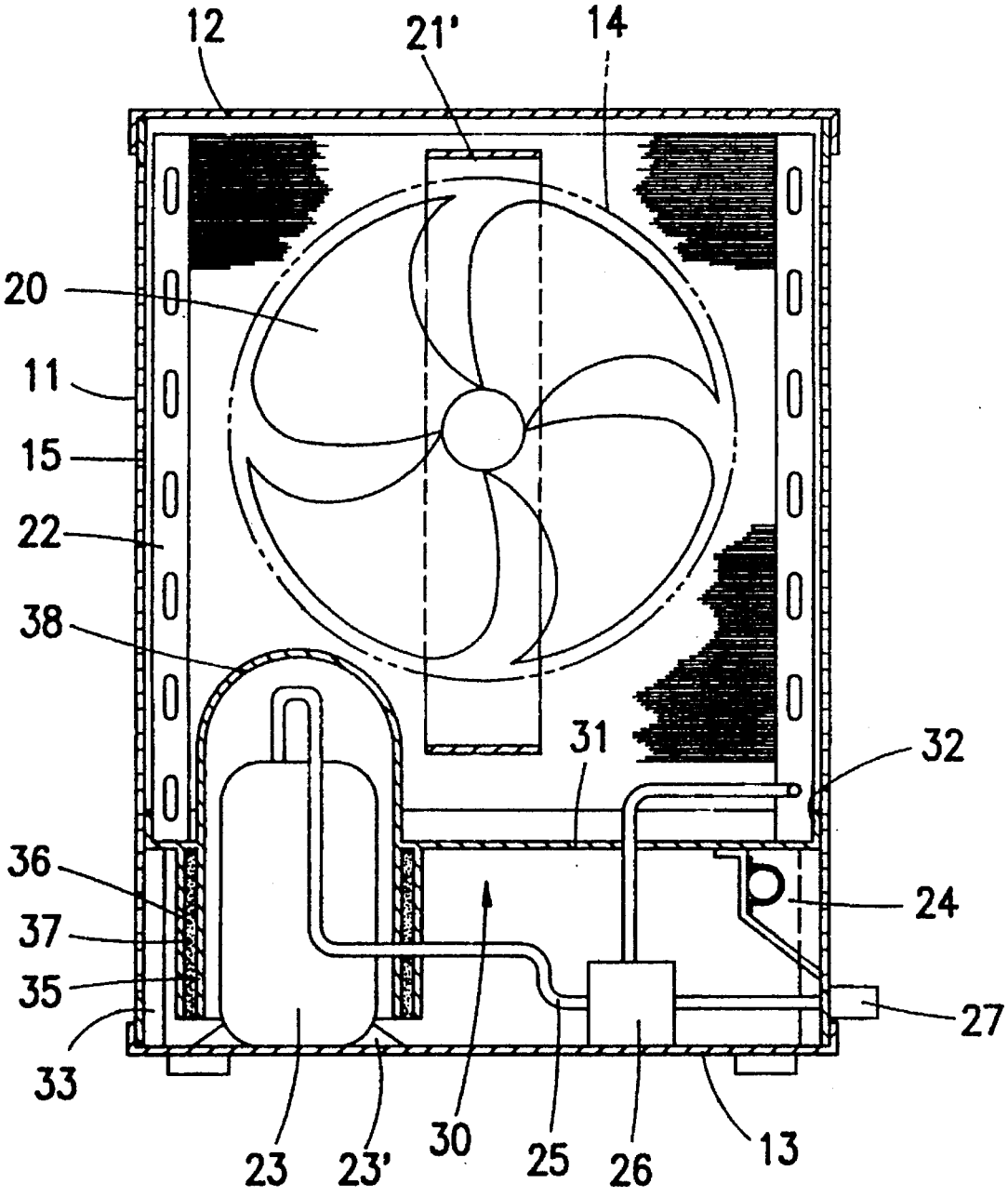
FIG. 3 is a vertically sectioned view of the front of an outdoor unit of an air conditioner according to the present invention.

FIG. 3 shows a front elevational view of the outdoor unit according to the present invention, and FIGS. 4A and 4B show a top plan view thereof. The outdoor unit comprises a housing formed by a front panel 10 having a fan 20 and a motor 21 mounted thereon, a top panel 12, a bottom panel 13, and a cover 11. The cover 11 has three vertical portions, namely a rear portion 11R, and two side portions 11S. Thus, the panels and cover cooperate to from top, bottom, front, rear and side walls of the housing. Inlet openings 15 are formed in the three vertical portions of the cover 11. A heat-exchanger 22 is mounted inwardly of the cover 11.

The outdoor unit further comprises a compressor 23 uprightly mounted on the bottom panel 13, and a partition means 30 isolating the compressor 23 from a heat-exchanger 22.

The front panel 10 provides an outlet opening 14 at its upper portion, and a bracket 21' is mounted on the rear surface of the front panel 10 for supporting the motor 21 and the fan 20. Vertical portions 10' of the front panel 10 are connected to respective forwardly facing ends of the cover 11 by a thread joint 40 (see FIG 4B).

The heat-exchanger 22 encompasses the left side, the right side and the rear side of the fan 20 in a U shape so as to increase the surface of the heat-exchange. At respective end surfaces of the heat-exchanger 22 brackets 22', 22' are provided for mounting to the portions 10' of the front panel 10 by means of the fasteners 40.

The compressor 23 is mounted on the left portion of the bottom panel 23' by a bracket 23' formed at the lower portion of the outdoor unit. The upper portion of the compressor 23 extends upwardly past the lower part of the heat-exchanger 22.

The partition means 30 includes a partition panel 31 for isolating the compressor 23 from the heat-exchanger 22. The panel 31 is connected to the front panel 10 and the cover 11. Further, respective corners of the rectangular partition panel 31 have vertical legs 33 for mounting on the bottom panel 13. Above the partition panel 31 is placed the heatexchanger 22.

Since the fan 20 and the compressor 23 are isolated from one another in respective vertically adjacent spaces by the partition panel 31, the superposition of noise generated from the fan 20 and the compressor, respectively can be prevented.

As shown in FIG.5, a pan 32 for collecting condensated water is refined by the upper peripheral area of the partition panel 31 to collect condensed water from the heat-exchanger 22. At the rear portion of the partition panel 31 there is formed a discharge tube 34 for draining collected water.

The domed cap 38 of the partition panel 31 covers the upper portion of the compressor 23. The partition means 30 includes an inner and an outer housing 35, 36 which encompass the lower portion of the compressor 23 and which are disposed at the undersurface of the partition panel 31. Between the inner and the outer housing 35, 36 a sound absorber 37 is provided for absorbing noise generated by compressor 23. The top panel 12 and the bottom panel 13 are connected to upper and lower areas of the front panel 10 and the cover 11 by threaded connectors.

A refrigerant tube 25 interconnects the indoor heat-exchanger (not shown) and the heat-exchanger 22. Numeral 26 is a refrigerant flow changing valve installed at the connecting point at which tubes from the heat-exchanger 22, the compressor 23 and the indoor unit are converge. Numeral 24 is a control portion comprising condenser and circuit board etc. for controlling the outdoor heat-exchanger.

According to the previous description, the fan 20 and the heatexchanger 22 are placed in the upper space (divided by the partition plate 31) of the outdoor unit, whereas the compressor 23, the valve 26 and the control portion 24 are arranged in the lower space (divided by the partition plate 31) of the outdoor unit.

The outdoor unit, having the construction as described above, is operated as follows. Firstly, as the operation of the fan 20 begins, outdoor air flows inwardly through a plurality of openings 15 which are provided at the left side, right side and rear side of the cover 11. The inflowing air passes the fan 20 after being heat-exchanged with the refrigerant in the heat-exchanger 22 positioned between the fan 20 and the cover 11. Next, the heat-exchanged outdoor air is circulated through, the opening 14 formed in the front plate 10. Since there are no other components interrupting the air flow in the upper portion of the outdoor unit the outdoor air from the heat-exchanger 22 is smoothly discharged through the opening 14. Thus, the volume of inflowing air is maximized and the heat-exchanging efficiency of the outdoor unit is improved.

Meanwhile, in the heating process, refrigerant conducted through the heat-exchanger 22 is heat-exchanged with outdoor air, and water is condenses on the outer surface of the heat-exchanger 22. Condensed water is collected in the pan 32 formed by the partition panel 31, and is then discharged through the drain pipe 34 formed at the left portion of the partition panel 31.

Further, since the compressor 23 is encompassed by the sound absorber 37 as well as the inner and the outer housings 35,36, the outward spread of noise generated during the operation of the compressor 23 can be relatively prevented.

Namely, generated noise collides with the inner and the outer housings 35,36 so as to be reduced, and is then absorbed by the sound absorber 37 so that overall noise diminishes. Therefore, noise generated during the operation of the compressor 23 is totally diminished.

Figure 6:
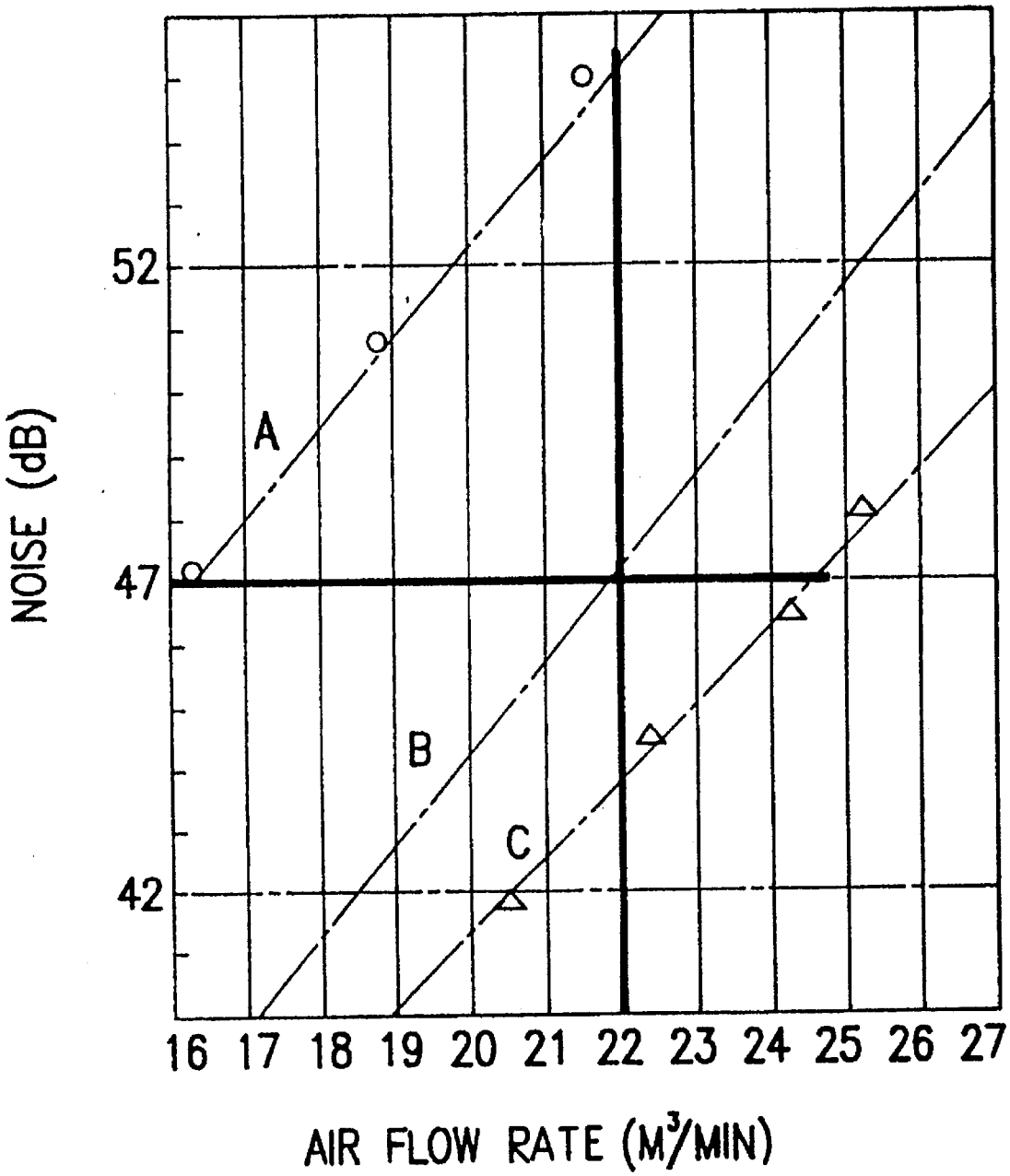
FIG. 6 is a diagram showing the relation between noise level and flow volume of the present invention and the prior art.

FIG. 6 is a diagram which shows relationships between noise and flow volume developed from comparative test of the present invention and the prior art. If the flow volume is 22 $m^3$/min, the noise level of the prior art "A" is 55 dB, whereas the noise level of the present invention "C" is 44 dB. Meanwhile, in the case that the noise level is 47 dB, flow volume of the prior art "B" is 22 $m^3$/min, whereas flow volume of the present invention is 24.5 $m^3$/min.

Accordingly, the outdoor unit according to the present invention provides a compact structure in which the inside space is divided into an upper portion and a lower portion by the partition panel. It has an advantage over the prior art in that less installation volume is needed for the same level of capacity.

It has the effect of obtaining a quieter operation by significant noise reduction, since the compressor is isolated from the fan by the partition panel and further is encompassed by a partition panel having a noise absorber.

Since outdoor air flows through the three sides, that is, left side, right side and rear side, an even intake pressure is applied to the fan, the dynamic balance of the fan is improved. Further, since the heat exchanger is formed with a "U" type in the horizontal cross-section and is arranged facing respective inflow openings, it has the effect that the efficiency of the heat-exchange is improved by increasing the effective surface of heat-exchanger. A sufficient flow volume and increased heat-exchanging surface can be attained even if a smaller sized fan and heat-exchanger are used, thereby enabling the size of the outdoor unit to be reduced.

Furthermore, the water drain pipe can be spaced from the ground since the condensated collect pan is formed by the partition plate. Thus, there is no need for the bottom panel to be spaced from the ground, so the bottom panel is installed upon the ground enbling the bottom panel to be firmmly mounted.

Furthermore, in the outdoor unit, only the partition panel 31 is added to the housing which is conventionally comprised of the panels 10, 12, 13 and the cover walls 11R, 11S, 11S. That is, a single component is supplemented, thereby obtaining a solid structure. Additionally, the bracket 21 supporting the fan motor is fastened to only the front panel to instead of to the bottom panel as in the prior art, and the vibration generated from the motor and the fan can be transferred to only the bottom. panel, thereby preventing the noise trnasfer of noise from the compressor.

What is claimed:

1. An outdoor air conditioning unit for use with a separate indoor air conditioning unit, comprising:

a housing including vertical front and rear walls, vertical side walls interconnecting the front and rear walls, a top wall, and a bottom wall, said housing forming an internal space;

a partition wall extending across said space to divide said space into upper and lower portions;

a fan, defining the only fan in said unit, disposed in said upper portion of said space and mounted to said front wall of said housing, said fan including blades disposed behind an air outlet opening formed in said front wall, and a motor connected to said blades for driving said blades;

a heat exchanger, defining the only heat exchanger in said unit, disposed in said upper space and having a U-shape formed by a rear portion and opposite side portions, said rear portion disposed opposite an air inlet opening in said rear wall of said housing, said side portions disposed opposite air inlet openings in respective side walls of said housing; and a compressor disposed in said lower portion of said space and mounted on said bottom wall.

2. The outdoor air conditioning unit according to claim 1 wherein a bracket is mounted to said front wall of said housing and extends rearwardly therefrom, said motor connected to said bracket, said blades being connected to said bracket through said motor.

3. The outdoor air conditioning unit according to claim 1 wherein said air inlet openings are formed in a generally U-shaped cover member forming said rear wall and side walls of said housing, said partition wall being connected to said front wall and said cover member.

4. The outdoor air conditioning unit according to claim 3 wherein said partition wall includes downwardly depending support legs supported on said bottom wall.

5. The outdoor air conditioning unit according to claim 4 including a condensate collection area extending along a top side of said partition wall.

6. The outdoor air conditioning unit according to claim 5 including a condensate drain pipe extending downwardly from said collection area.

7. The outdoor air conditioning unit according to claim 1 wherein said partition wall comprises a generally horizontally oriented portion and a dome shaped portion projecting higher than said generally horizontally oriented portion, said dome shaped portion surrounding an upper section of said compressor.

8. The outdoor air conditioning unit according to claim 1 wherein said partition wall further includes inner and outer upright wall portions surrounding a lower portion of said compressor, said upright wall portions being horizontally spaced apart to form therebetween a space containing sound absorbing material.

9. The outdoor air conditioning unit according to claim 1 wherein said compressor is disposed beneath said fan.

10. An outdoor air conditioning unit for use with a separate indoor air conditioning unit, comprising:

a housing including vertical front and rear walls, vertical side walls interconnecting the front and rear walls, a top wall, and a bottom wall, said housing forming an internal space;

a partition wall extending across said space to divide said space into upper and lower portions;

a fan disposed in said upper portion of said space and mounted to said front wall of said housing, said fan including blades disposed behind an air outlet opening formed in said front wall, and a motor connected to said blades for driving said blades;

a heat exchanger disposed in said upper space and having a U-shape formed by a rear portion and opposite side portions, said rear portion disposed opposite an air inlet opening in said rear wall of said housing, said side portions disposed opposite air inlet openings in respective side walls of said housing; and a compressor disposed in said lower portion of said space and mounted on said bottom wall;

said partition wall comprising a generally horizontally oriented portion and a dome-shaped portion projecting higher than said generally horizontally oriented portion, said dome-shaped portion surrounding an upper section of said compressor.

11. The outdoor air conditioning unit according to claim 10 wherein said partition wall further includes inner and outer upright wall portions disposed beneath said dome shaped portion and surrounding a lower portion of said compressor, said inner and outer wall portions spaced horizontally apart to form therebetween a space containing sound absorbing material.

12. An outdoor air conditioning unit for use with a separate indoor air conditioning unit, comprising:

a housing including vertical front and rear walls, vertical side walls interconnecting the front and rear walls, a top wall, and a bottom wall, said housing forming an internal space;

a partition wall extending across said space to divide said space into upper and lower portions;

a fan disposed in said upper portion of said space and mounted to said front wall of said housing, said fan including blades disposed behind an air outlet opening formed in said front wall, and a motor connected to said blades for driving said blades;

a heat exchanger disposed in said upper space and having a U-shape formed by a rear portion and opposite side portions, said rear portion disposed opposite an air inlet opening in said rear wall of said housing, said side portions disposed opposite air inlet openings in respective side walls of said housing; and a compressor disposed in said lower portion of said space and mounted on said bottom wall;

said partition wall including inner and outer upright wall portions surrounding a lower portion of said compressor, said upright wall portions being horizontally spaced apart to form therebetween a space containing sound absorbing material.

* * * * *